US008777216B2

(12) United States Patent
Otsuka et al.

(10) Patent No.: US 8,777,216 B2
(45) Date of Patent: Jul. 15, 2014

(54) IMAGE FORMING APPARATUS

(71) Applicant: Riso Kagaku Corporation, Tokyo (JP)

(72) Inventors: Shinichiro Otsuka, Ibaraki-ken (JP); Masaaki Shinohara, Ibaraki-ken (JP)

(73) Assignee: Riso Kagaku Corporation, Minato-Ku, Tokyo (JP)

( * ) Notice: Subject to any disclaimer, the term of this patent is extended or adjusted under 35 U.S.C. 154(b) by 0 days.

(21) Appl. No.: 13/870,293

(22) Filed: Apr. 25, 2013

(65) Prior Publication Data

US 2013/0300053 A1 Nov. 14, 2013

(30) Foreign Application Priority Data

May 9, 2012 (JP) ..... 2012-107569

(51) Int. Cl.
*B65H 29/24* (2006.01)
*B65H 7/16* (2006.01)
*B65H 5/22* (2006.01)

(52) U.S. Cl.
CPC . *B65H 5/222* (2013.01); *B65H 7/16* (2013.01)
USPC ..... 271/194

(58) Field of Classification Search
USPC ..... 271/11, 90, 94, 96, 98, 99, 106, 275, 271/276, 264, 265.01, 265.04, 194, 196, 271/197
See application file for complete search history.

(56) References Cited

U.S. PATENT DOCUMENTS

2010/0117293 A1* 5/2010 Shinohara ..... 271/264

FOREIGN PATENT DOCUMENTS

JP 4-41358 * 2/1992
JP 2006-137027 A 6/2006
JP 2011-161833 * 8/2011

OTHER PUBLICATIONS

Machine translation of Detailed Description section of JP2011-161833.*

* cited by examiner

*Primary Examiner* — Thomas Morrison
(74) *Attorney, Agent, or Firm* — Nath, Goldberg & Meyer; Jerald L. Meyer

(57) ABSTRACT

An image forming apparatus includes a suction fan unit, a conveyor belt, a plurality of sheet-pressing rollers, and a control unit. The conveyor belt conveys a recording sheet suctioned by the suction fan unit, to a printer part. The sheet-pressing rollers are arranged at intervals in a main scanning direction orthogonal to a conveying direction of the recording sheet by the conveyor belt, and press the recording sheet onto the conveyor belt before the recording sheet is conveyed to the printer part. When a type of the recording sheet is a type meeting a predetermined condition, the control unit controls a suction strength of a suction fan unit such that a suction strength at both end portions of the suction part in the main scanning direction is higher than a suction strength at a central portion of the suction part in the main scanning direction.

5 Claims, 10 Drawing Sheets

IMAGE FORMING APPARATUS

CROSS REFERENCE TO RELATED APPLICATION

This application claims benefit of priority under 35 U.S.C. §119 to Japanese Patent Application No. 2012-107569 filed on May 9, 2012, the entire contents of which are incorporated by reference herein.

BACKGROUND OF THE INVENTION

1. Field of the Invention

The present invention relates to an image forming apparatus for forming an image on a recording sheet conveyed in a state of being suctioned on a conveyor belt.

2. Description of the Related Art

In recent years, there has been widespread an image forming apparatus capable of achieving high-speed printing such as a line-type inkjet printer or the like that performs image formation (printing) in one pass in a main scanning direction. In this type of an image forming apparatus, in order to stably convey the recording sheet, the recording sheet is conveyed while being suctioned onto the conveyor belt.

The conveyance of a curled recording sheet such as a warped or corrugated sheet may cause a trouble such as a paper jam. Therefore, during conveyance, the curled recording sheet is flattened through the use of sheet-pressing rollers (SS rollers) (refer to for example, Japanese Patent Application Laid-Open Publication No. 2006-137027).

The sheet-pressing rollers are located at intervals in the main scanning direction, and are configured such that one sheet-pressing roller presses the portion of the recording sheet floated from the conveyor belt due to curl, to thereby cause the curled portion to escape to the portion of the recording sheet located between the sheet-pressing roller and the adjacent sheet-pressing roller.

However, in the case of a recording sheet having moisture adsorption and a thin and fragile recording sheet, since a curl generated is large, the above-mentioned sheet-pressing rollers cannot sufficiently flatten the curl, thereby possibly generating a wrinkle on the recording sheet.

SUMMARY OF THE INVENTION

The present invention has been made in consideration of the above-mentioned circumstances, and its object is to provide an image forming apparatus in which a curl of a recording sheet is more effectively flattened and the recording sheet is conveyed by a conveyor belt while being suctioned onto the conveyor belt.

An image forming apparatus according to a first aspect of the present invention includes a suction part; a conveyor belt that conveys a recording sheet suctioned by the suction part, to an image forming part; a plurality of sheet-pressing rollers that is arranged at intervals in a main scanning direction orthogonal to a conveying direction of the recording sheet by the conveyor belt, the sheet-pressing rollers pressing the recording sheet onto the conveyor belt before the recording sheet is conveyed to the image forming part; and a controller that controls suction strength of the suction part such that when a type of the recording sheet is a type meeting a predetermined condition, there is achieved a distribution in which a suction strength at both end portions of the suction part in the main scanning direction is higher than a suction strength at a central portion of the suction part in the main scanning direction.

In the image forming apparatus according to the first aspect of the present invention, the suction part has a plurality of negative-pressure generating parts that generates a negative pressure on a suction face of the conveyor belt, the negative-pressure generating parts are associated with respective divided regions on the suction face, the divided regions being set at least in the main scanning direction, and the controller controls the suction strength of the suction part by adjusting the strength of the negative pressure generated by each of the negative-pressure generating parts.

The image forming apparatus according to the first aspect of the present invention further includes a determining part that determines whether or not a type of the recording sheet designated in a printing job for forming an image on the recording sheet is a type meeting the predetermined condition, wherein when the determining part determines that the type of the recording sheet meets the predetermined condition, the controller controls the suction strength of the suction part so as to achieve the distribution, at execution of the printing job.

An image forming apparatus according to a second aspect of the present invention includes a suction part; a conveyor belt that conveys a recording sheet suctioned by the suction part, to an image forming part; and a plurality of sheet-pressing rollers that is arranged at intervals in a main scanning direction orthogonal to a conveying direction of the recording sheet by the conveyor belt, the sheet-pressing rollers pressing the recording sheet onto the conveyor belt before the recording sheet is conveyed to the image forming part, wherein the suction part includes a plurality of members having different suction strengths in the suction part such that there is achieved a distribution that a suction strength at both end portions of the suction part in the main scanning direction is higher than a suction strength at a central portion of the suction part in the main scanning direction.

In the image forming apparatuses according to the first and second aspects of the present invention, when the portion of the recording sheet, which is floated from the conveyor belt due to a state of being curled, is pressed onto the conveyor belt with the plurality of sheet-pressing rollers, a force trying to spread the recording sheet to both sides in the main scanning direction is acted on the recording sheet.

Here, in the portion of the recording sheet near the center in the main scanning direction, the portion of the recording sheet in contact with the conveyor belt, in a state of being curled, is not strongly suctioned onto the conveyor belt. Therefore, when the portion of the recording sheet, which is floated from the conveyor belt, is pressed by the sheet-pressing rollers, the recording sheet including the portion in contact with the conveyor belt moves to the both end sides in the main scanning direction.

Accordingly, during passage through the sheet-pressing rollers, the portion of the recording sheet, which is near the center in the main scanning direction and which is floated from the conveyor belt, is distributed and collected, in places between the portions which are in contact with and strongly suctioned onto the conveyor belt near the right and left ends in the main scanning direction, and between plural pairs of sheet-pressing rollers adjacent to each other.

Accordingly, since the portion of the recording sheet, which is collected between the sheet-pressing rollers, becomes small, wrinkles are hard to be generated in the recording sheet passing through the sheet-pressing rollers. As a result, the curled recording sheet is flattened. Therefore, the curled recording sheet can be flattened more effectively, and the flattened recording sheet can be suctioned onto and conveyed by the conveyor belt.

In the image forming apparatus according to the first aspect of the present invention, since the controller controls the strength of the negative pressure generated by the negative-pressure generating parts associated with the respective divided regions on the suction face of the conveyor belt, which are set in the main scanning direction of the suction face of the conveyor belt, the suction strength of the suction part can be easily controlled such that there is achieved the distribution in which the suction strength on the both end portions of the suction part in the main scanning direction is higher than the suction strength at the central portion of the suction part in the main scanning direction.

In the image forming apparatus according to the first aspect of the present invention, determination on whether or not the suction strength of the suction part is controlled such that there is achieved the distribution in which the suction strength on the both end portions of the suction part in the main scanning direction is higher than the suction strength at the central portion of the suction part in the main scanning direction, can be made on the basis of the type of the recording sheet designated in the printing job.

DESCRIPTION OF THE EMBODIMENTS

Figure 1:
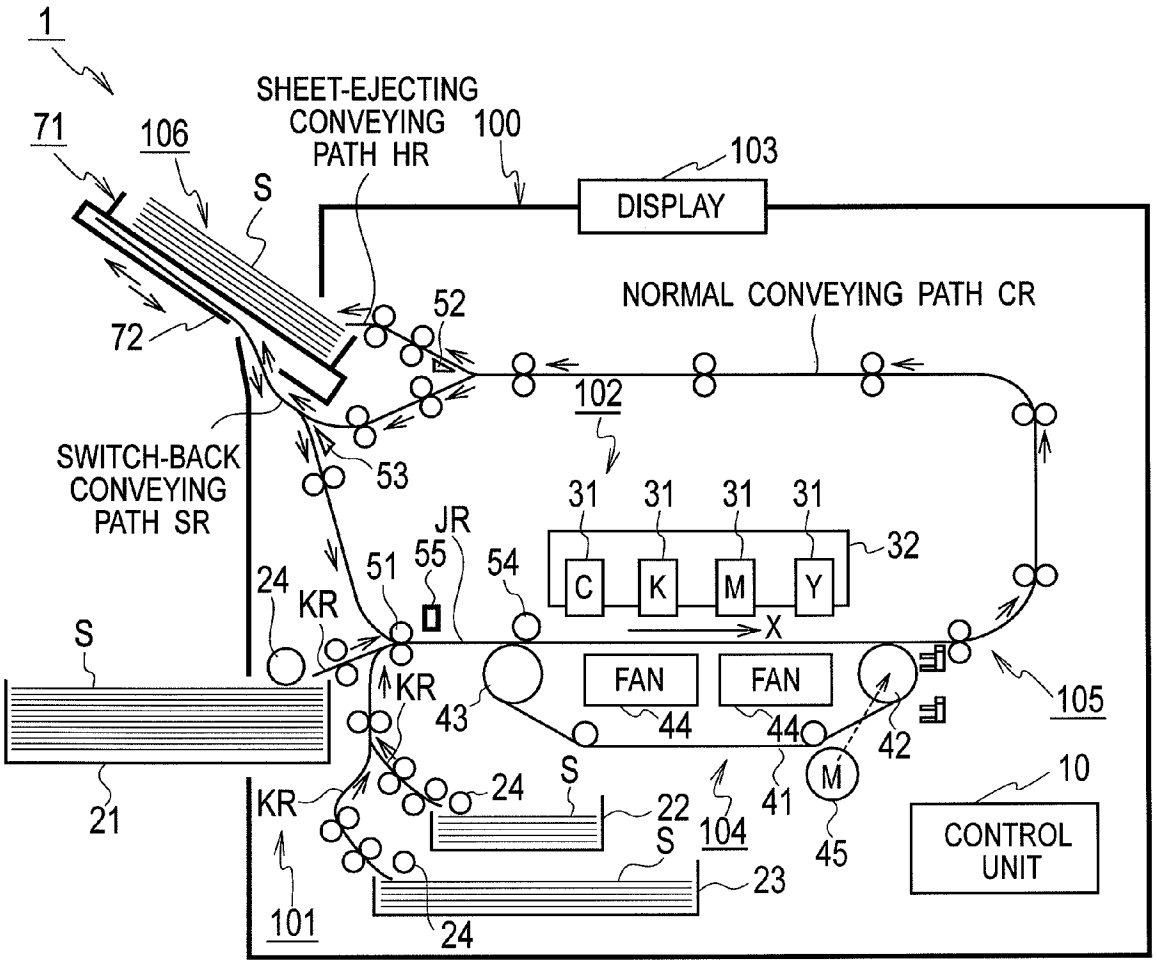
FIG. 1 is an explanatory drawing that illustrates a schematic configuration of a multidrop-type inkjet printer according to an embodiment of the present invention.

Hereinafter, an embodiment of the present invention will be described with reference to drawings. Meanwhile, the same or equivalent parts and components through the drawings are given the same or equivalent reference numerals, and description thereof will be omitted or simplified.

FIG. 1 is an explanatory diagram that illustrates a schematic configuration of a line-type inkjet printer according to an embodiment of the present invention. As shown in FIG. 1, the line-type inkjet printer (image forming apparatus) in the present embodiment (hereinafter abbreviated as "inkjet printer") 1 includes a control unit 10, a sheet feeding part 101, a printer part 102 (image forming part), a display 103, a belt platen mechanism part 104, a recording-sheet circulatory conveying path part 105, and a sheet ejecting part 106, inside and outside a housing 100.

The sheet feeding part 101 includes a side sheet-feeding table 21 arranged on a side surface of the housing 100, and a plurality of sheet feeding tables 22 and 23 arranged at a left lower portion in the housing 100. The side sheet-feeding table 21 is a so-called manual bypass tray, and can set a recording sheet S of an arbitrary specification thereon. In contrast, the sheet feeding tables 22 and 23 are so-called sheet feeding cassettes, and can set recording sheets S respectively different in size (A4, A3, B4, B5 and so on), in orientation (vertical, horizontal), and in paper quality (for example, thick recording sheets having a large basis weight and thin recording sheets having a small basis weight) thereon.

An uppermost recording sheet S among unprinted recording sheets S stacked on each of the side sheet-feeding table 21 and the sheet feeding tables 22 and 23 is fed one by one by each of the sheet feeding rollers 24 and then, is conveyed along a sheet-feeding conveying path KR by a driving mechanism such as a roller. Then, a front end of the fed recording sheet S is guided by a pair of resist rollers 51 provided in the recording-sheet circulatory conveying path part 105, and the timing was adjusted such that the location of the front end of the recording sheet S is aligned at the pair of resist rollers 51.

The printer part 102 is fixedly installed on the downstream side of the sheet feeding part 101 and on the upstream side of the recording-sheet circulatory conveying path part 105, and is located at the substantially central portion in the housing 100.

In the printer part 102, a plurality of line-type inkjet heads corresponding to a plurality of colors of ink (hereinafter abbreviated as "inkjet heads") 31 are arranged in order of C (cyan), K (black), M (magenta), and Y (yellow) from the upstream side toward the downstream side. The inkjet heads 31 of different colors are attached to a head holder 32, and are disposed at regular intervals in a conveying direction X (subscanning direction) of the recording sheet S by the belt platen mechanism part 104.

Meanwhile, in the present embodiment, there will be described an example in which the four inkjet heads 31 corresponding to four colors (CKMY) of ink are provided. However, for example, in the case of printing only characters, an inkjet head for only one color (K) may be used, and thus at least one inkjet head 31 may be provided.

Here, the inkjet heads 31 provided for respective colors are formed having the same structure. In each inkjet head 31, a plurality of head blocks each having a plurality of nozzles aligned along a main scanning direction Y perpendicular to the sheet of FIG. 1 (refer to FIG. 2) is arranged on one line along the main scanning direction Y (not shown). Two lines each having the plurality of head blocks arranged are arranged in the subscanning direction (conveying direction X) orthogonal to the main scanning direction Y (not shown). The two lines having the plurality of head blocks arranged are arranged alternately in a staggered manner such that, in the adjacent lines, the respective head blocks partially overlap each other (not shown).

Each of the inkjet heads 31 prints a printing image by a multi-drop inkjet method capable of changing the number of dots to be ejected from the nozzle (not shown) up to five dots, to the same pixel. Printing multivalued data specifying the number of ejected dots of ink droplet from the inkjet head of color corresponding to each pixel is generated by a below-mentioned CPU 90 of the control unit 10 on the basis of printing data of a printing job, which is input from a client terminal 14.

The belt platen mechanism part 104 is arranged below the plurality of inkjet heads 31 so as to face the printer part 102.

In the belt platen mechanism part 104, in order to place and convey the unprinted recording sheet S fed by the sheet feeding part 101, or the recording sheet S whose one surface has been printed conveyed in a below-mentioned circulatory conveying path JR, a belt-like belt platen 41 (conveyor belt) having a lot of suction holes is extended between a driving pulley 42 rotationally driven by a motor 45 and a driven pulley 43.

A suction fan unit 44 (suction part) for generating a negative pressure that air-sucks the recording sheet S onto the belt platen 41 are provided between the driving pulley 42 and the driven pulley 43.

The belt platen 41 has lots of suction holes. A suction face 41*a* of the belt platen 41 for the recording sheet S (refer to FIG. 2) communicates with the suction fan unit 44 via the suction holes. The negative pressure is supplied to the suction holes by a suction force generated by the suction fan unit 44. Accordingly, the suction force toward the belt platen 41 acts on the recording sheet S arranged on the belt platen 41 by the negative pressure generated in the suction holes.

Figure 2:
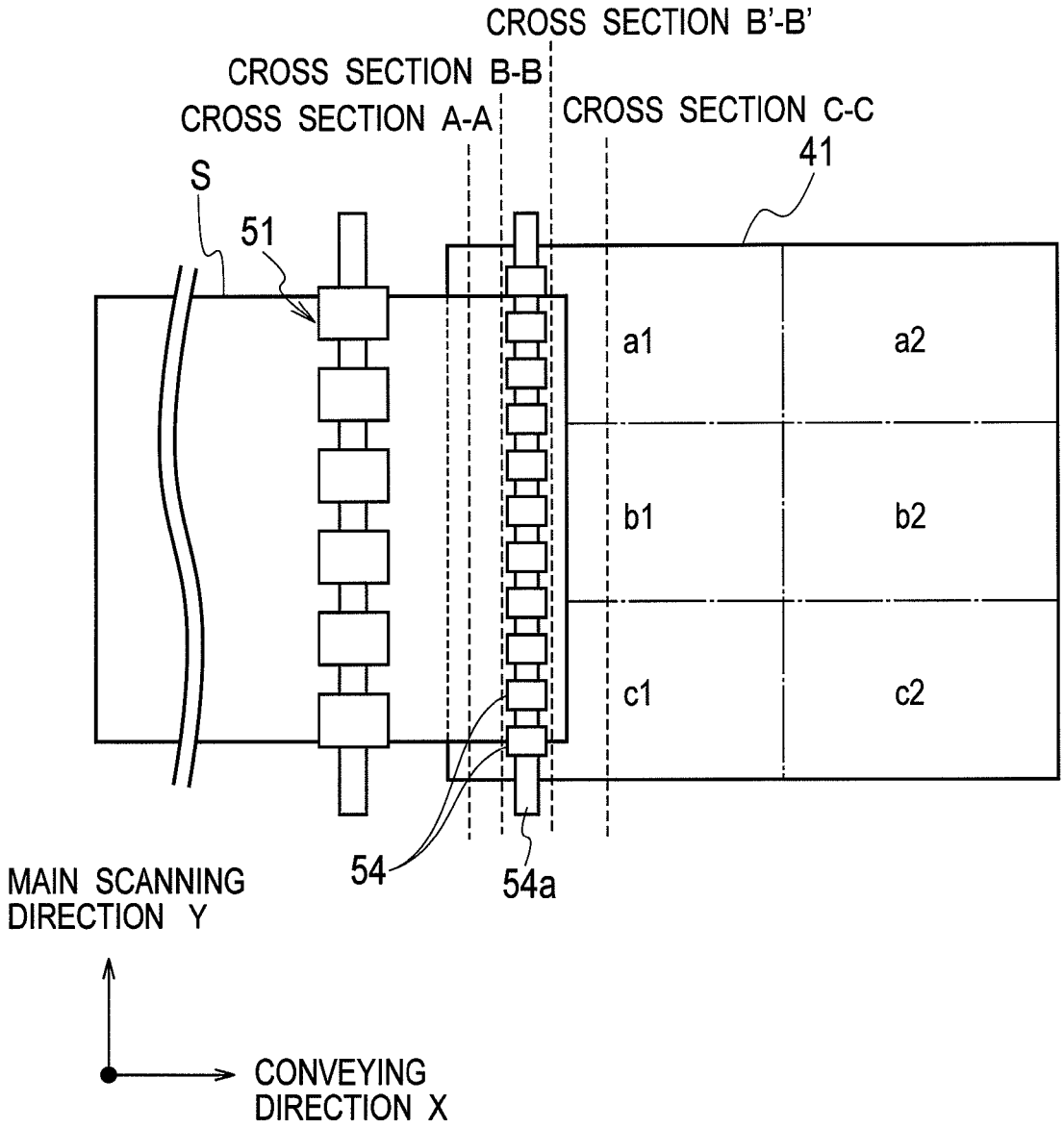
FIG. 2 is an enlarged plan drawing of a belt platen in FIG. 1.

As shown in an enlarged plan drawing of FIG. 2, the suction fan unit 44 has six suction fans 44*a* to 44*f* (negative-pressure-generating parts) totally in three rows (left side, center and right side in the main scanning direction Y when viewing the downstream side from the upstream side in the conveying direction X) in the main scanning direction Y vertically extending in FIG. 2 and in two rows (upstream side and downstream side) in the conveying direction X horizontally extending in FIG. 2.

Specifically, the suction fans 44*a* and 44*b* are arranged in left regions a1 (upstream side in the conveying direction X) and a2 (downstream side in the conveying direction X) of the suction face 41*a* in the main scanning direction Y, respectively. The suction fans 44*c* and 44*d* are arranged in central regions b1 (upstream side in the conveying direction X) and b2 (downstream side in the conveying direction X) of the suction face 41*a* in the main scanning direction Y, respectively. The suction fans 44*e* and 44*f* are arranged in right regions c1 (upstream side in the conveying direction X) and c2 (downstream side in the conveying direction X) of the suction face 41*a* in the main scanning direction Y, respectively.

In addition, in the belt platen mechanism part 104 shown in FIG. 1, when the recording sheet S is placed on the belt-like belt platen 41, the recording sheet S is air-sucked by the suction fans 44*a* to 44*f* via the suction holes formed in the belt platen 41, and in a state where the recording sheet S is fixed to the belt platen 41, the recording sheet S is conveyed by rotation of the belt platen 41 in the subscanning direction. On the recording sheet S in the process of conveyance, a printing image is printed in full-color by the plurality of inkjet heads 31 of the printer part 102 arranged above the passage of the recording sheet S.

The recording-sheet circulatory conveying path part 105 has the circulatory conveying path JR in which the circulation of the recording sheet S is carried out through the printer part 102 in order to perform single-sided printing or duplex printing on the recording sheet S fed from the sheet feeding part 101 at the printer part 102. The recording-sheet circulatory conveying path part 105 is installed, in the circulatory conveying path JR, by being branched into the sheet-feeding conveying path KR for conveying the unprinted recording sheet S from the side sheet-feeding table 21, and a sheet-ejecting conveying path HR for conveying the printed recording sheet S on the side of a sheet ejecting table 71.

The circulatory conveying path JR is annularly installed by a usual conveying path CR for conveying directly the printed recording sheet S whose one surface (front surface) is printed by the printer part 102, in the sheet-ejecting direction, and a switch-back conveying path SR for switching the conveying direction to thereby make switch-back for the purpose of performing duplex printing (front surface and back surface)

of the printed recording sheet S whose one surface (front surface) has been printed, in the middle of the usual conveying path CR, through the use of first and second conveying-path switch levers 52 and 53 using electromagnetic valves or the like.

The circulatory conveying path JR enables the recording sheet S, which are to be duplex-printed, to circulate through the printer part 102. Meanwhile, while passing through the pair of resist rollers 51 and being transferred to the belt platen 41, the recording sheet S conveyed from the sheet-feeding conveying path KR or the switch-back conveying path SR to the circulatory conveying path JR is pressed onto the belt platen 41 by a plurality of sheet-pressing rollers 54, and thus the state of curling is corrected.

As shown in FIG. 2, the plurality of sheet-pressing rollers 54 is provided at regular intervals in the main scanning direction Y, and is rotationally driven by the same rotary shaft 54*a* in conjunction with one another. The recording sheet S pressed by the plurality of sheet-pressing rollers 54 is fed to the printer part 102, and an image is formed on the sheet S. When passing through the printer part 102, the recording sheet S passes through a region where the recording sheet S is suctioned onto the belt platen 41 by the negative pressure generated by the suction fan unit 44.

The region where the recording sheet S is suctioned onto the belt platen 41 is divided into regions a1 and a2 (divided regions) where the recording sheet S is suctioned by the negative pressure generated by the left suction fans 44*a* and 44*b* in the main scanning direction Y, the regions b1, b2 (divided regions) where the recording sheet S is suctioned by the negative pressure generated by the central suction fans 44*c* and 44*d* in the main scanning direction Y, and the regions c1 and c2 (divided regions) where the recording sheet S is suctioned by the negative pressure generated by the right suction fans 44*e* and 44*f* in the main scanning direction Y.

Next, there will be described a process of flattening the recording sheet S in a state of being curled, through the use of the plurality of sheet-pressing rollers 54. Meanwhile, here, it is assumed that the recording sheet S immediately after passing through the pair of resist rollers 51 is repeatedly curled in a corrugated manner in the main scanning direction Y.

First, there will be described a usual suction pattern in which the suction fans 44*a* to 44*f* equalize the negative pressure generated in each of the regions a1 to c2 of the belt platen 41 with reference to FIGS. 3A to 3D.

Figure 3A:
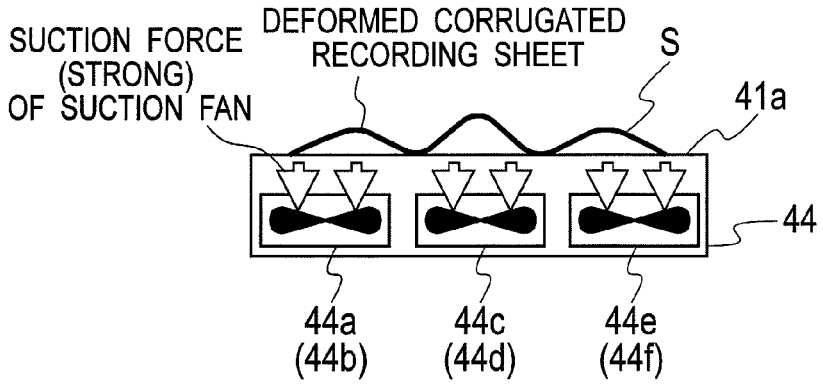
FIG. 3A is an explanatory diagram that illustrates a state of a curled recording sheet immediately after passage through resist rollers in the case where suction fans in FIG. 2 are driven in a usual suction pattern.

As shown in FIG. 3A, the recording sheet S (cross-section taken along A-A in FIG. 2) immediately after passing through the pair of resist rollers 51, receives the suction force onto the belt platen 41 from the suction fans 44*a* to 44*f* entirely in the main scanning direction Y.

Figure 3B:
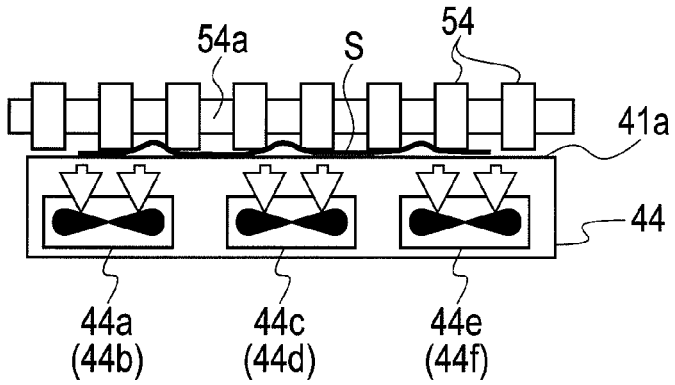
FIG. 3B is an explanatory diagram that illustrates a state of the curled recording sheet immediately before passage through the sheet-pressing rollers in the case where the suction fans in FIG. 2 are driven in the usual suction pattern.

When the recording sheet S in this state comes near the plurality of sheet-pressing rollers 54 (cross-section taken along B-B in FIG. 2), as shown in FIG. 3B, the portion of the recording sheet S, which is floated from the belt platen 41 due to curl on the recording sheet S, is pressed by the respective sheet-pressing rollers 54.

When the portion of the recording sheet S, which is floated from the belt platen 41, is pressed by the respective sheet-pressing rollers 54, a force trying to spread the floated portion of the recording sheet S to the both sides in the main scanning direction Y, acts on the portion of the recording sheet S.

However, when the suction force onto the belt platen 41 is applied to the recording sheet S from the suction fans 44*a* to 44*f* entirely in the main scanning direction Y, the portion of the recording sheet S in contact with the belt platen 41 is strongly suctioned onto the belt platen 41 in a state of being curled, and thus, becomes hard to move in the main scanning direction Y.

Figure 3C:
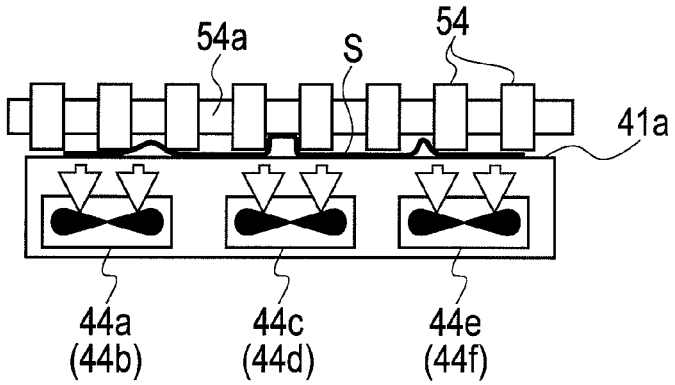
FIG. 3C is an explanatory diagram that illustrates a state of the curled recording sheet during passage through sheet-pressing rollers in the case where the suction fans in FIG. 2 are driven in the usual suction pattern.

Therefore, in the process of passing through the plurality of sheet-pressing rollers 54 (cross-section taken along B'-B' in FIG. 2), as shown in FIG. 3C, the portion of recording sheet S, which is floated from the belt platen 41, is collected between two sheet-pressing rollers 54 and 54 adjacent to each other without being flattened.

Figure 3D:
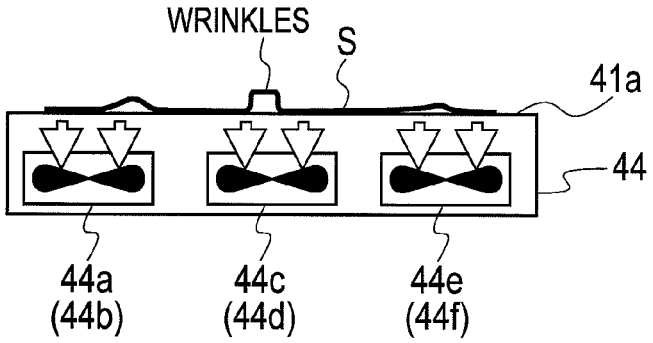
FIG. 3D is an explanatory diagram that illustrates a state of the curled recording sheet after passage through the sheet-pressing rollers in the case where the suction fans in FIG. 2 are driven in the usual suction pattern.

After passing through the plurality of sheet-pressing rollers 54 (cross-section taken along C-C in FIG. 2), as shown in FIG. 3D, a wrinkle is generated on the recording sheet S. Feeding of the recording sheet S having such wrinkles to the printer part 102 may cause trouble such as paper jam.

Particularly, the portion of the recording sheet S, which is floated from the center of belt platen 41 in the main scanning direction Y, is subjected to a force trying to move the portion of the recording sheet S, which is floated from both right and left sides of the belt platen 41, and thus, is harder to be flattened in comparison with the portion of the recording sheet S, which is floated from both right and left sides of the belt platen 41. Accordingly, further more wrinkles are likely to be generated on the portion of the recording sheet S located at the center of the belt platen 41 in the main scanning direction Y.

In addition, such circumstance tends to be generated especially in the fragile thin recording sheet S, the recording sheet S or the like largely curled due to moisture absorption.

Therefore, it can be considered that, by the stop of the left and right suction fans 44*a*, 44*b*, 44*e*, and 44*f* in the main scanning direction Y, the portions of the recording sheet S on both right and left sides in the main scanning direction Y are caused to easily move in the main scanning direction Y.

Next, a center-prioritized suction pattern will be described with reference to FIGS. 4A to 4D.

Figure 4A:
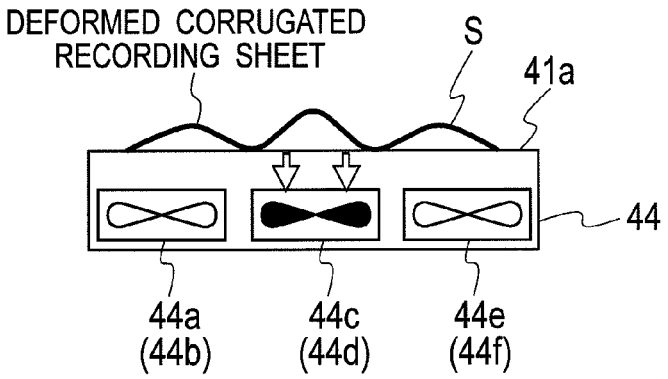
FIG. 4A is an explanatory diagram that illustrates a state of the curled recording sheet immediately after passage through the resist rollers in the case where the suction fans in FIG. 2 are driven in a center-prioritized suction pattern.

As shown in FIG. 4A, the recording sheet S immediately after passing through the pair of resist rollers 51 (cross-section taken along A-A in FIG. 2) receives the suction force onto the belt platen 41 only from the central suction fans 44*c* and 44*d* in the main scanning direction Y. The suction force ensures high-speed conveyance of the recording sheet S on the belt platen 41.

Figure 4B:
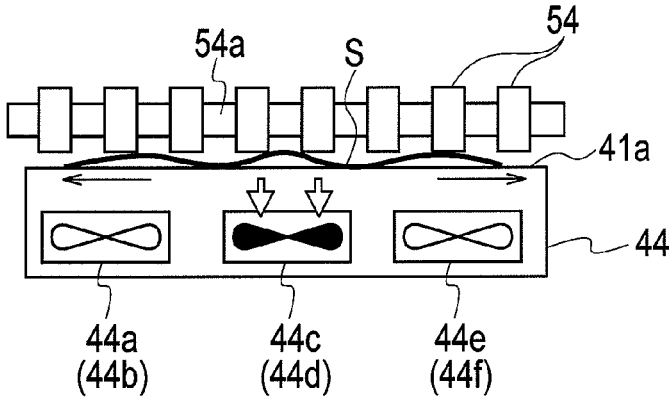
FIG. 4B is an explanatory diagram that illustrates a state of the curled recording sheet immediately before passage through the sheet-pressing rollers in the case where the suction fans in FIG. 2 are driven in the center-prioritized suction pattern.

When the recording sheet S in this state comes near the plurality of sheet-pressing rollers 54 (cross-section taken along B-B in FIG. 2), as shown in FIG. 4B, the portion of the recording sheet S, which is floated from the belt platen 41, is pressed by the respective sheet-pressing rollers 54, and a force trying to spread the floated portion of the recording sheet S to both sides in the main scanning direction Y acts.

Here, at the portions of the recording sheet S near the right and left end in the main scanning direction Y, the portion of the recording sheet S in contact with the belt platen 41, in a state of being curled, is not suctioned onto the belt platen 41. Therefore, when the portion of the recording sheet S, which is floated from the belt platen 41, is pressed by the respective sheet-pressing rollers 54, the portion of the recording sheet S moves toward the both sides in the main scanning direction Y and is flattened.

In contrast, in the portion of recording sheet S near the center in the main scanning direction, the portion of the recording sheet S in contact with the belt platen 41, in a state of being curled, is strongly suctioned onto the belt platen 41. Accordingly, even when the portion of recording sheet S, which is floated from the belt platen 41, is pressed by the sheet-pressing rollers 54, the portion of the recording sheet S is hard to move in the main scanning direction Y.

Figure 4C:
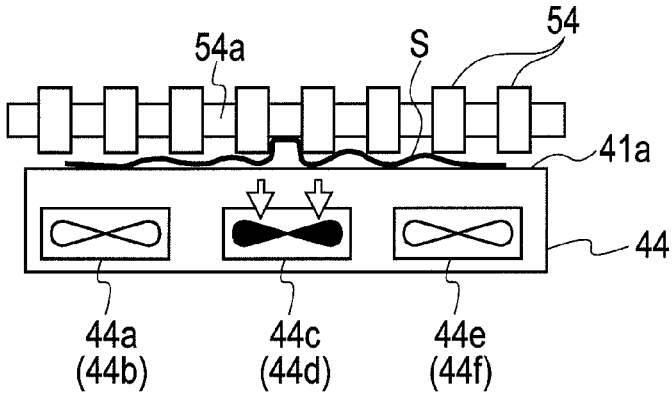
FIG. 4C is an explanatory diagram that illustrates a state of the curled recording sheet during passage through the sheet-pressing rollers in the case where the suction fans in FIG. 2 are driven in the center-prioritized suction pattern.

Therefore, in the portion of the recording sheet S near the center in the main scanning direction Y, in the same way as in the usual suction pattern, the portion of the recording sheet S, which is floated from the belt platen 41, in the process of passing through the plurality of sheet-pressing rollers 54 (cross-section taken along B'-B' in FIG. 2), is collected between the two sheet-pressing rollers 54 and 54 adjacent to each other without being flattened, as shown in, for example, FIG. 4C.

Figure 4D:
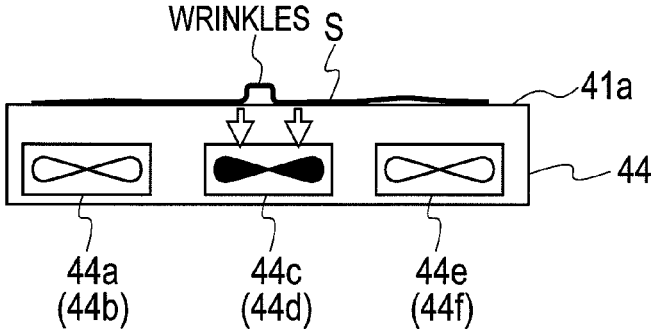
FIG. 4D is an explanatory diagram that illustrates a state of the curled recording sheet after passage through the sheet-pressing rollers in the case where the suction fans in FIG. 2 are driven in the center-prioritized suction pattern.

Then, after passing through the plurality of sheet-pressing rollers 54 (cross-section taken along C-C in FIG. 2), there arise wrinkles on the recording sheet S as shown in FIG. 4D.

Particularly, since the portion of the recording sheet S, which is floated from the belt platen 41, is concentratedly collected between the two sheet-pressing rollers 54 and 54 adjacent to each other by a limited number, existing near the center in the main scanning direction Y, the wrinkles generated after the recording sheet S passes through the sheet-pressing rollers 54 become large.

Therefore, it is considered that, opposite to the center-prioritized suction pattern, by the stop of the central suction fans 44*c* and 44*d* in the main scanning direction Y, the portion of the central recording sheet S in the main scanning direction Y is caused to easily move in the main scanning direction Y.

Next, a right and left side-prioritized suction pattern will be described with reference to FIGS. 5A to 5D.

Figure 5A:
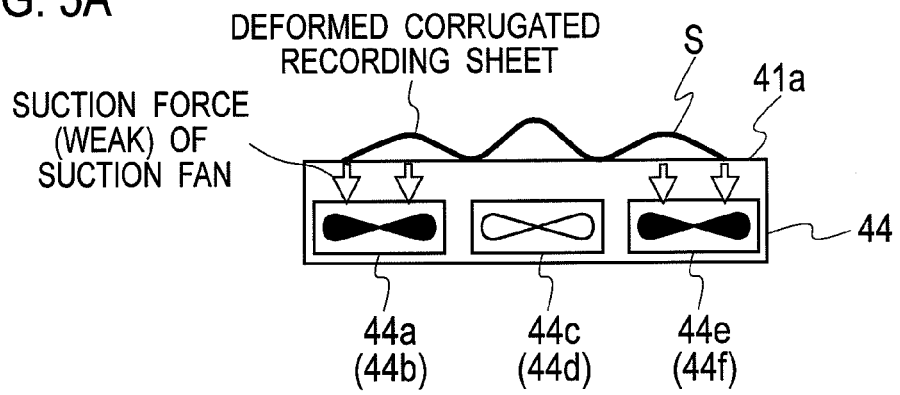
FIG. 5A is an explanatory diagram that illustrates a state of the curled recording sheet immediately after passage through the resist rollers in the case where the suction fans in FIG. 2 are driven in a right and left sides-prioritized suction pattern.

As shown in FIG. 5A, the recording sheet S immediately after passing through the pair of resist rollers 51 (cross-section taken along A-A in FIG. 2), receives the suction force onto the belt platen 41, from only the suction fans 44*a*, 44*b*, 44*e*, and 44*f* on the left and right sides in the main scanning direction Y. The suction force ensures high-speed conveyance of the recording sheet S by the belt platen 41.

Figure 5B:
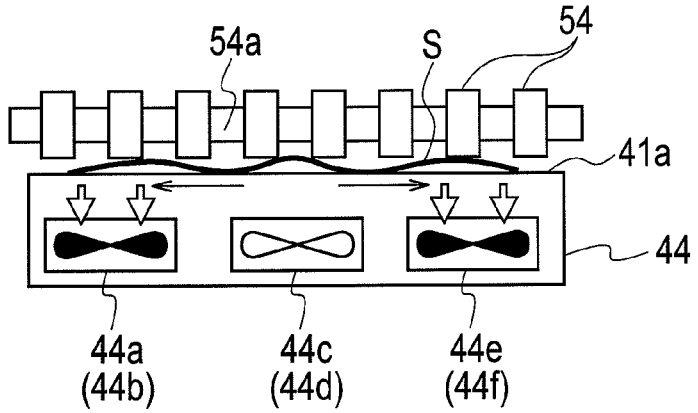
FIG. 5B is an explanatory diagram that illustrates a state of the curled recording sheet immediately before passage through the sheet-pressing rollers in the case where the suction fans in FIG. 2 are driven in the right and left sides-prioritized suction pattern.

When the recording sheet S in this state comes near the plurality of sheet-pressing rollers 54 (cross-section taken along B-B in FIG. 2), as shown in FIG. 5B, the portion of the recording sheet S, which is floated from the belt platen 41, is pressed by the respective sheet-pressing rollers 54, and thus a force trying to spread the floated portions of the recording sheet S to both sides in the main scanning direction Y acts.

Here, at the portions of the recording sheet S near the right and left ends in the main scanning direction Y, the portion of the recording sheet S in contact with the belt platen 41, in a state of being curled, is strongly suctioned onto the belt platen 41. For this reason, even when the portion of the recording sheet S, which is floated from the belt platen 41, is pressed by the respective sheet-pressing rollers 54, the portion of the recording sheet S is hard to move in the main scanning direction Y.

In contrast, at the portion of the recording sheet S located near the center in the main scanning direction Y, the portion of the recording sheet S in contact with the belt platen 41, in a state of being curled, is not strongly suctioned onto the belt platen 41. For this reason, when the portion of the recording sheet S, which is floated from the belt platen 41, is pressed by the sheet-pressing rollers 54, the recording sheet S including the portion in contact with the belt platen 41 moves to the both sides in the main scanning direction Y.

Figure 5C:
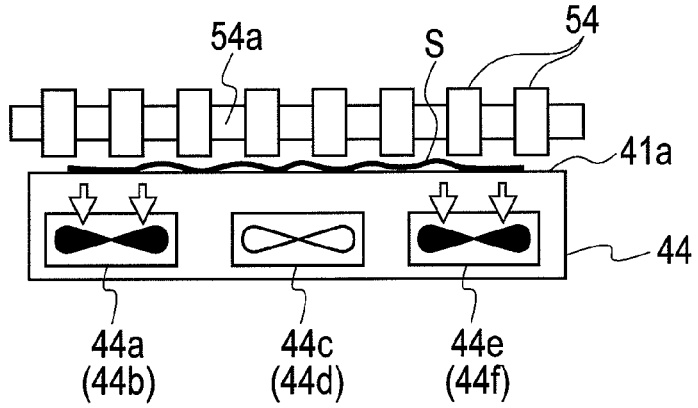
FIG. 5C is an explanatory diagram that illustrates a state of the curled recording sheet during passage through the sheet-pressing rollers in the case where the suction fans in FIG. 2 are driven in the right and left sides-prioritized suction pattern.

Accordingly, while the recording sheet S passes through the plurality of sheet-pressing rollers 54 (cross-section taken along B'-B' in FIG. 2), as shown in FIG. 5C for example, the portion of the recording sheet S which is near the center in the main scanning direction Y and which is floated from the belt platen 41 is distributed and collected in places between the portions which are in contact with and strongly suctioned onto the belt platen 41 near the right and left ends in the main scanning direction Y and between multiple pairs of sheet-pressing rollers 54 and 54 adjacent to each other.

Figure 5D:
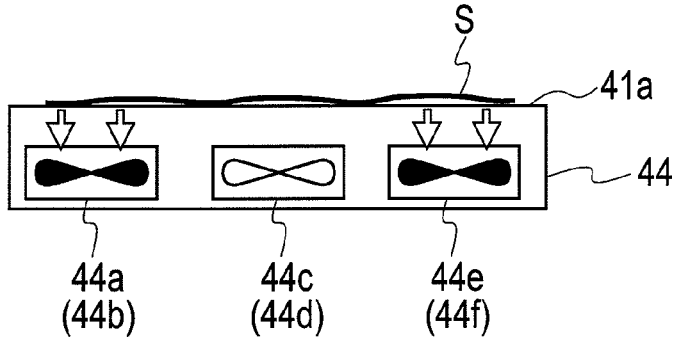
FIG. 5D is an explanatory diagram that illustrates a state of the curled recording sheet after passage through the sheet-pressing rollers in the case where the suction fans in FIG. 2 are driven in right and left sides-prioritized suction pattern.

As a result, the portion of the recording sheet S collected between the individual sheet-pressing rollers 54 and 54 becomes small. After passage of the recording sheet S through the plurality of sheet-pressing rollers 54 (cross-section taken along C-C in FIG. 2), as shown in FIG. 5D, wrinkles are hard to be generated in the recording sheet S resulting in the flattening of the curled recording sheet S.

In the inkjet printer 1 in the present embodiment, when the thin recording sheet S is used for printing, the suction fans 44*a* to 44*f* of the suction fan unit 44 are driven in a thin-sheet pattern so as to obtain the suction pattern as shown in FIGS. 5A to 5D.

Figure 6:
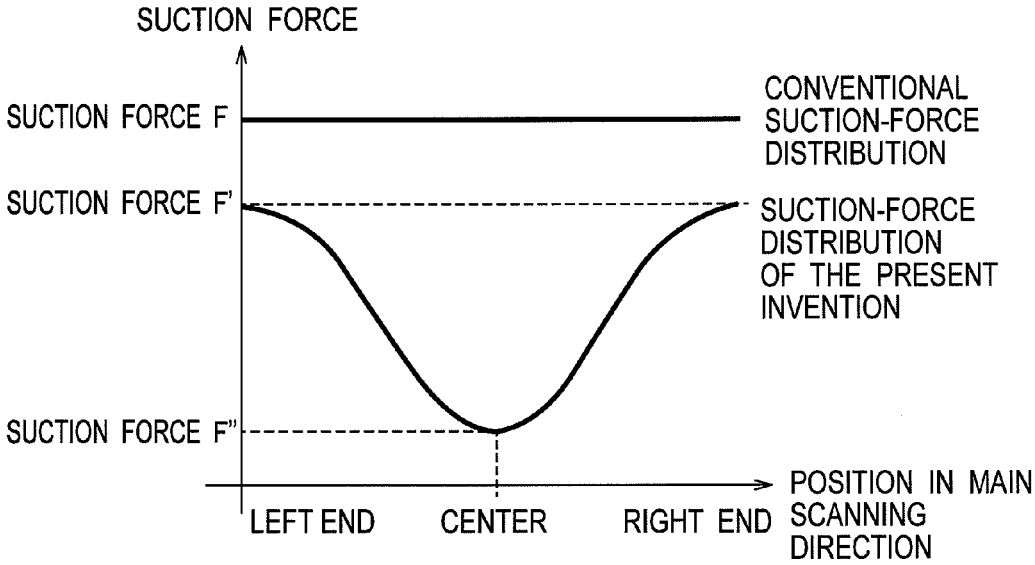
FIG. 6 is a graph that shows distribution of a suction force on a suction face of the belt platen in the case where the suction fans in FIG. 2 are driven in the thin-sheet pattern.

As shown in a graph in FIG. 6 for example, Driving contents of the suction fans 44*a* to 44*f* in the thin-sheet pattern include the realization of a distribution in which the right and left end portions of the recording sheet S in the main scanning direction Y has a suction force relatively higher than the central portion of the recording sheet S.

At this time, a suction force F' in the regions a1, a2, c1, and c2 of the left and right ends of the recording sheet S (Refer to FIG. 2) is set lower than a suction force F in the regions a1, a2, b1, b2, c1, and c2 in the usual suction pattern described above with reference to FIGS. 3A to 3D (Refer to FIG. 2). Particularly, it is desired that the thinner the recording sheet S used for printing is, the smaller the value of the suction force F' is.

In the thin-sheet pattern, the suction fans 44*a* to 44*f* associated with the respective regions a1, a2, b1, b2, c1, and c2 are driven such that the suction force generated in the regions a1, a2, c1, and c2 located on the left and right sides on the suction face 41*a* of the belt platen 41 shown in FIG. 2 is higher than the suction force generated in the central regions b1 and b2.

Figure 7A:
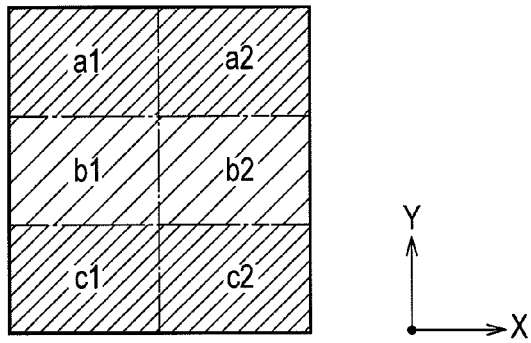
FIG. 7A is an explanatory diagram that illustrates a first distribution pattern of the suction force on the suction face of the belt platen in the case where the suction fans in FIG. 2 are driven in the thin-sheet pattern.
Figure 7B:
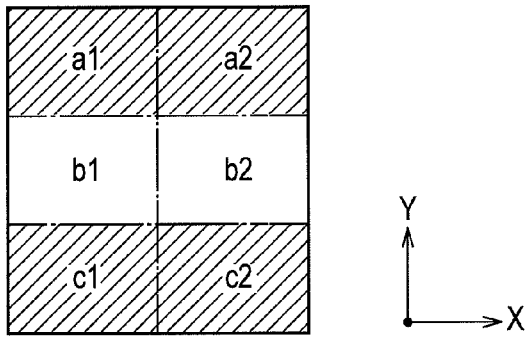
FIG. 7B is an explanatory diagram that illustrates a second distribution pattern of the suction force on the suction face of the belt platen in the case where the suction fans in FIG. 2 are driven in the thin-sheet pattern.
Figure 7C:
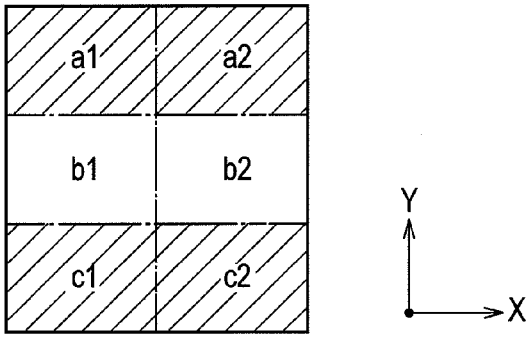
FIG. 7C is an explanatory diagram that illustrates a third distribution pattern of the suction force on the suction face of the belt platen in the case where the suction fans in FIG. 2 are driven in the thin-sheet pattern.
Figure 7C:
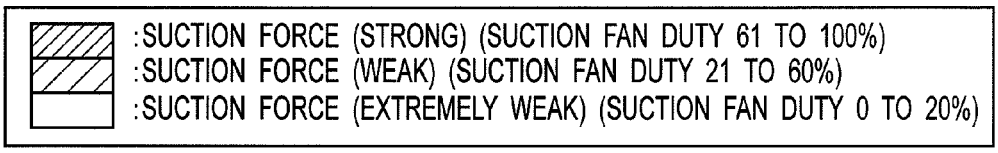

As shown in FIGS. 7A to 7C for example, a specific driving pattern (thin-sheet pattern) of the suction fans 44*a* to 44*f* includes three patterns in which the suction fans 44*a*, 44*b*, 44*e*, and 44*f* associated with the left and right side regions a1, a2, c1, and c2, and the suction fans 44*c* and 44*d* associated with the central regions b1 and b2, are driven in a combination of "strong suction force" and "weak suction force" (first distribution pattern), a combination of "strong suction force" and "extremely weak suction force" (second distribution pattern), and a combination of "weak suction force" and "extremely weak suction force" (third distribution pattern).

The "strong suction force", the "weak suction force", and the "extremely weak suction force" can be defined in accordance with driving Duty of fan motors of the suction fans 44*a* to 44*f*. For example, the "strong suction force" can be defined as Duty=61 to 100%, the "weak suction force" as Duty=21 to 60%, and the "extremely weak suction force" as Duty=0 to 20%.

In a thick-sheet pattern, the fan motors of the suction fans 44*a* to 44*f* may be driven with the same Duty.

In the inkjet printer 1, in the case of using the thick recording sheet S (including the recording sheet not being thin and having usual thickness), the suction fans 44*a* to 44*f* of the suction fan unit 44 are driven in the thick-sheet pattern so as to obtain the suction pattern as described above with reference to FIGS. 3A to 3D.

Incidentally, the printed recording sheet S that has been conveyed by the belt platen 41 and that has passed below the printer part 102 is conveyed in the usual conveying path CR of the circulatory conveying path JR, in order for drying ink on the recording sheet S to ensure time for being able to be dried. Therefore, the usual conveying path CR is bent so as to come round above the printer part 102. The printed recording sheet S to be ejected is conveyed from the usual conveying path CR toward the sheet ejecting table 71 of the sheet ejecting part 106 through the sheet-ejecting conveying path HR.

In contrast, the printed recording sheet S not to be ejected is conveyed from the usual conveying path CR to the switch-back conveying path SR in the circulatory conveying path JR. At this time, the conveying direction of the recording sheet S is changed by being switched through the use of the first conveying-path switch lever 52 before moving on to the sheet ejecting part 106 in the usual conveying path CR, and the recording sheet S moves on to a recording-sheet guide frame 72 formed on a back surface of the sheet ejecting table 71 of the sheet ejecting part 106. After reversing the front end of the recording sheet S in the recording-sheet guide frame 72, the conveying direction of the recording sheet S is changed by being switched through the use of the second conveying-path switch lever 53, and then the recording sheet S is conveyed to the printer part 102 and the belt platen mechanism part 104, toward the pair of resist rollers 51.

A light-reflective (or light-transmissive) recording-sheet detecting optical sensor 55 is installed in the recording-sheet circulatory conveying path part 105. The recording-sheet detecting optical sensor 55 is installed between the pair of resist rollers 51 in the sheet-feeding conveying path KR ad the belt platen 41, and functions as a sensor for detecting the type (size, thin/thick sheets) of the recording sheet S.

The thin recording sheet S can be distinguished from the thick recording sheet recording sheet S (including the recording sheet S having usual thickness) through the use of the basis weight per unit area (unit $g/m^2$). As a guide, the recording sheet S of 52 $g/m^2$ or less can be defined as the thin recording sheet S. In addition, the thin recording sheet S may be distinguished from the thick recording sheet S through the use of "pure flexural rigidity" (unit $\mu N \cdot m^2/m$) as an alternative parameter proportional to the basis weight. As a guide, the recording sheet S of 75 $\mu N \cdot m^2/m$ or less can be defined as the thin recording sheet S.

In the present embodiment, the thickness of the recording sheet S having a basis weight of 53 $g/m^2$ or less is defined as a threshold value, and depending on whether or not the thickness of the recording sheet S exceeds the threshold value, a distinction is made between the thick recording sheet S and the thin recording sheet S.

The sheet ejecting part 106 includes the sheet ejecting table 71 installed to be inclined with respect to the housing 100.

The sheet ejecting table 71 includes a function of storing the printed recording sheet S conveyed in the usual conveying path CR and the sheet-ejecting conveying path HR which are provided in the recording-sheet circulatory conveying path part 105, and a function of reversing the front end of the recording sheet S by the switch-back of the sheet, through the use of the recording-sheet guide frame 72 formed on the back surface of the sheet ejecting table 71, for printing the back surface of the recording sheet S whose one surface (front surface) has been printed.

Figure 8:
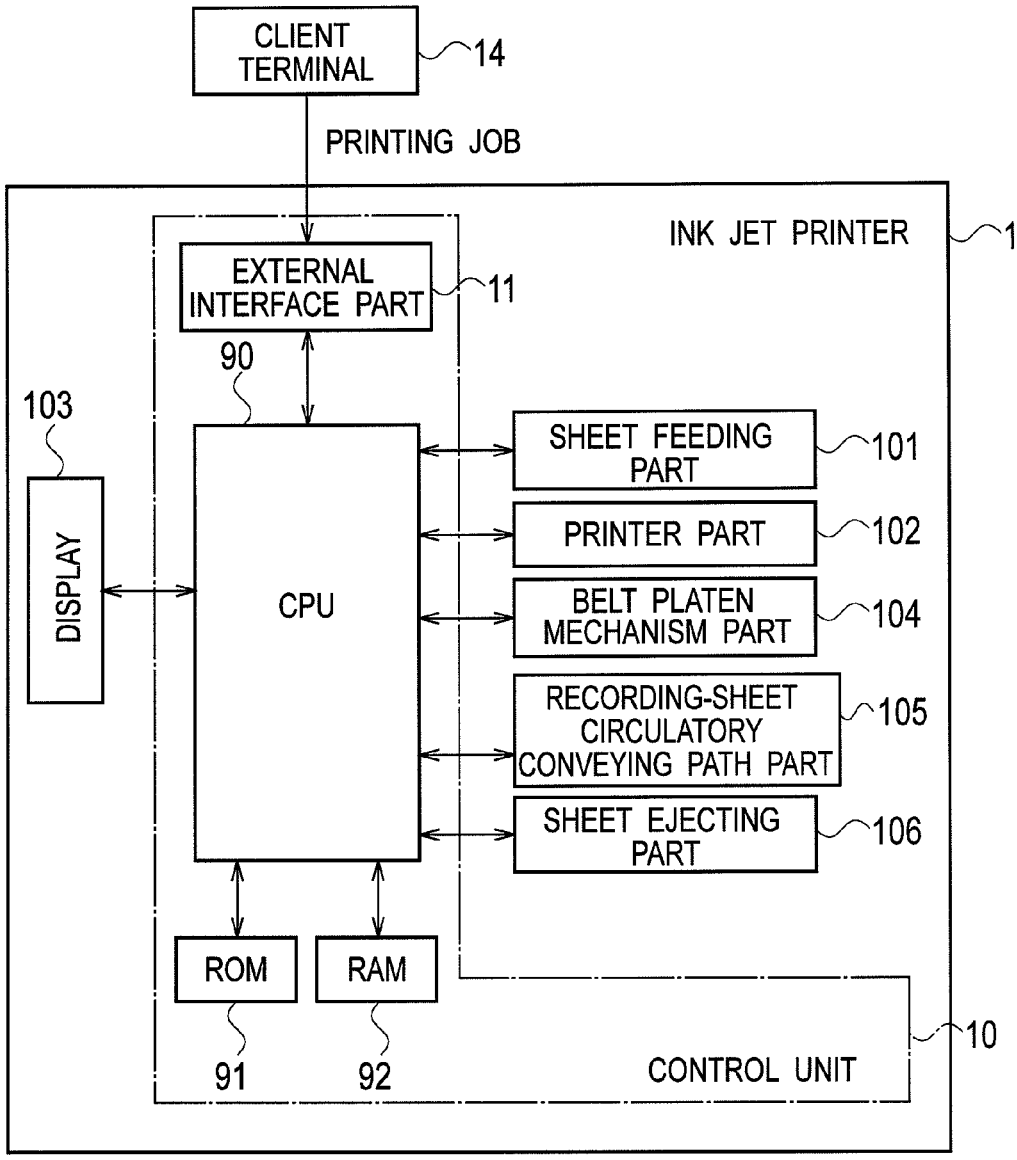
FIG. 8 is a block diagram that illustrates a structure of a control system of the inkjet printer in FIG. 1.

FIG. 8 is a block diagram showing an electrical configuration of the control unit 10 in FIG. 1. The control unit 10 receives a printing job from the client terminal 14 via an external interface part 11. The printing job includes postscript data and attribute data of a printed image. The control unit 10 generates raster data of the printed image from the postscript data of the received printing job. The inkjet printer 1 executes printing of the printed image on the recording sheet S in the printer part 102 under conditions specified in the attribute data of the printing job. The attribute data includes the type of the recording sheet S used for printing.

Printing multivalued data specifying the number of dots of the ink droplet to be ejected from each of the inkjet heads 31 of each color at the printer part 102, which corresponds to each pixel of the printed image, is generated by the CPU 90 of the control unit 10 on the basis of the postscript data of the printing job input from the client terminal 14.

In addition, the display 103 is connected to the CPU 90 of the control unit 10. As shown in FIG. 1, the display 103 is arranged in an upper portion of the inkjet printer 1. The display 103 can be used as an input device and an information output device, which are related to various operations of the inkjet printer 1.

As shown in FIG. 8, the control unit 10 includes the CPU 90. The CPU 90 controls the operation of each part of the inkjet printer 1 on the basis of a program and setting information which are stored in a ROM 91 and in accordance with contents set and input from the display 103.

A RAM 92 is provided in the control unit 10, and a frame memory area is formed in the RAM 92. In the frame memory area, there is temporarily stored the raster data of the printed image generated by the CPU 90 from the postscript data of the printing job, which is input from the client terminal 14 to the control unit 10, until the raster data is output to the printer part 102.

Next, there will be described, with reference to a flow chart in FIG. 9, procedure of driving control processing of the suction fans 44*a* to 44*f* of the suction fan unit 44, which is performed by the CPU 90 of the control unit 10 in accordance with the program stored in the ROM 91.

Figure 9:
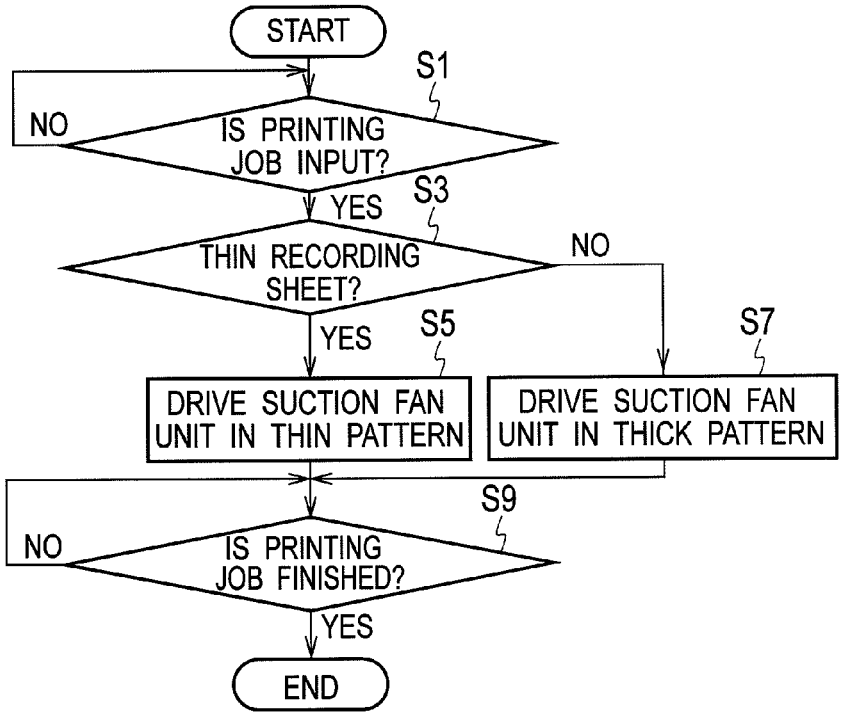
FIG. 9 is a flow chart that shows an example of a procedure of driving control processing of a suction fan unit, performed in accordance with a program stored in a ROM by a CPU of a control unit in FIG. 8.

As shown in FIG. 9, the CPU 90 first confirms whether or not the printing job is input from the client terminal 14 (Step S1). If the printing job is not input (NO in Step S1), the CPU 90 waits until the printing job is input. If the printing job is input (YES in Step S1), the CPU 90 determines whether or not the recording sheet S used for printing is thin through the use of the attribute data of the input printing job (Step S3).

If the recording sheet S is thin (YES in Step S3), the CPU 90 drives, in the thin-sheet pattern, the suction fans 44*a* to 44*f* of the suction fan unit 44 (Step S5), and finishes the series of processing after the completion of the printing job (YES in Step S9). Thereafter, the procedure in FIG. 9 is repeatedly performed.

If the recording sheet S is not thin (NO in Step S3), the CPU 90 drives, in the thick-sheet pattern, the suction fans 44*a* to 44*f* of the suction fan unit 44 (Step S7), and finishes the series of processing after the completion of the printing job (YES in Step S9). Thereafter, the procedure in FIG. 9 is repeatedly performed.

As described above, in the inkjet printer 1, at the time of occurrence of the printing job using the thin recording sheet S, each of the suction fans 44*a* to 44*f* associated with the regions a1, a2, b1, b2, c1, and c2 is configured to be driven in the thin driving pattern.

As a result, the suction force generated in the left and right regions a1, a2, c1, and c2 on the suction face 41*a* of the belt platen 41 becomes higher than the suction force generated in the central regions b1 and b2. Therefore, the portion of the recording sheet S, which is floated from the center of the belt platen 41 in the main scanning direction Y, can be distributed to the places between the individual sheet-pressing rollers 54 and 54, between the right and left ends in the main scanning direction Y, and thus the wrinkles can be prevented from being generated on the recording sheet S.

Figure 10:
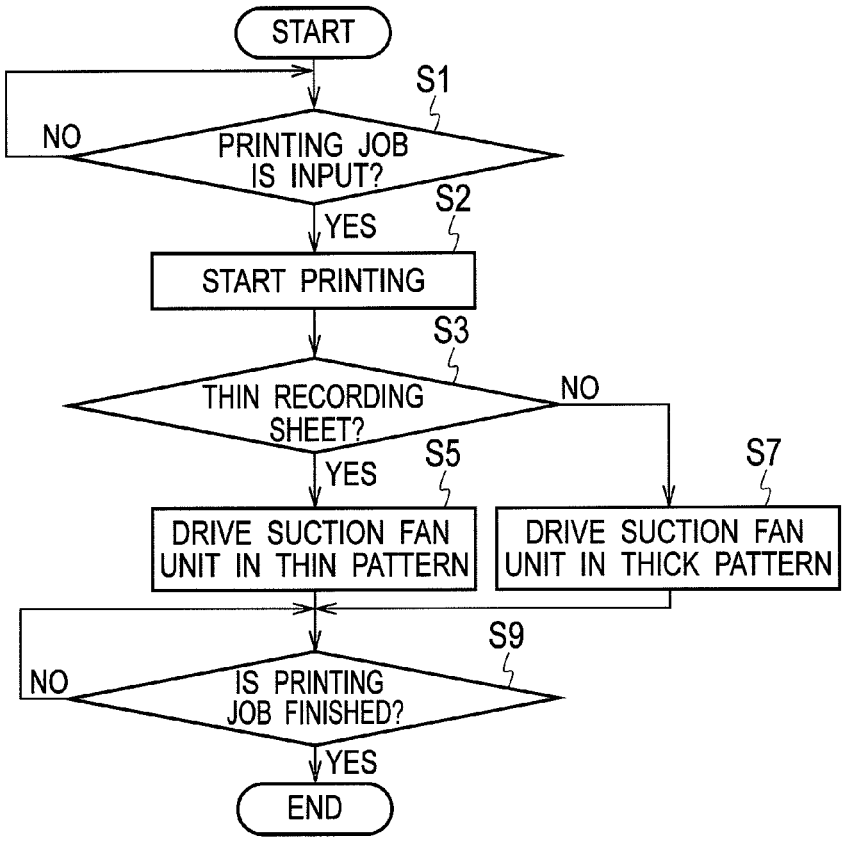
FIG. 10 is a flow chart that shows another example of the procedure of the driving control processing of the suction fan unit, performed in accordance with the program stored in the ROM by the CPU of the control unit in FIG. 8.

Meanwhile, in the present embodiment, although it is identified whether or not the recording sheet S used for printing is thin on the basis of the attribute data of the printing job, it may be identified whether or not the recording sheet S used for printing is thin depending on the thickness of the recording sheet S, which is detected by the recording-sheet detecting optical sensor 55. In this case, as shown in a flow chart in FIG. 10, after the start of printing by the printing job in which the input is confirmed in Step S1 in FIG. 9 (Step S2), it may be identified whether or not the recording sheet S used for printing is thin depending on the detection result of the recording-sheet detecting optical sensor 55 (Step S3).

In the present embodiment, in the case where the recording sheet S is thin, there has been described the case of a distribution in which the both end portions in the main scanning direction Y have a suction strength onto the belt platen 41 higher than the central portion. However, the condition for the above-mentioned distribution of the suction strength may relate to factors other than the thickness of the recording sheet S such as the case where it is detected that a curl having a predetermined level or more exists in the recording sheet S, or the case where the recording sheet S has a predetermined size or more.

In the present embodiment, there has been described, as an example, the case where the generation of a negative pressure on the suction face 41*a* of the belt platen 41 by the suction fan unit 44 suctions the recording sheet S. However, the present invention can be also applied to the case where the recording sheet S is suctioned onto the suction face 41*a* of the belt platen 41 by anything other than the negative pressure.

Specifically, the present invention can be also applied to the case where the recording sheet S is configured to be suctioned by static electricity generated on the suction face 41*a* of the belt platen 41 through the use of any publicly-known method, or the case where the suction face 41*a* of the belt platen 41 is made up of material having suction.

Figure 11A:
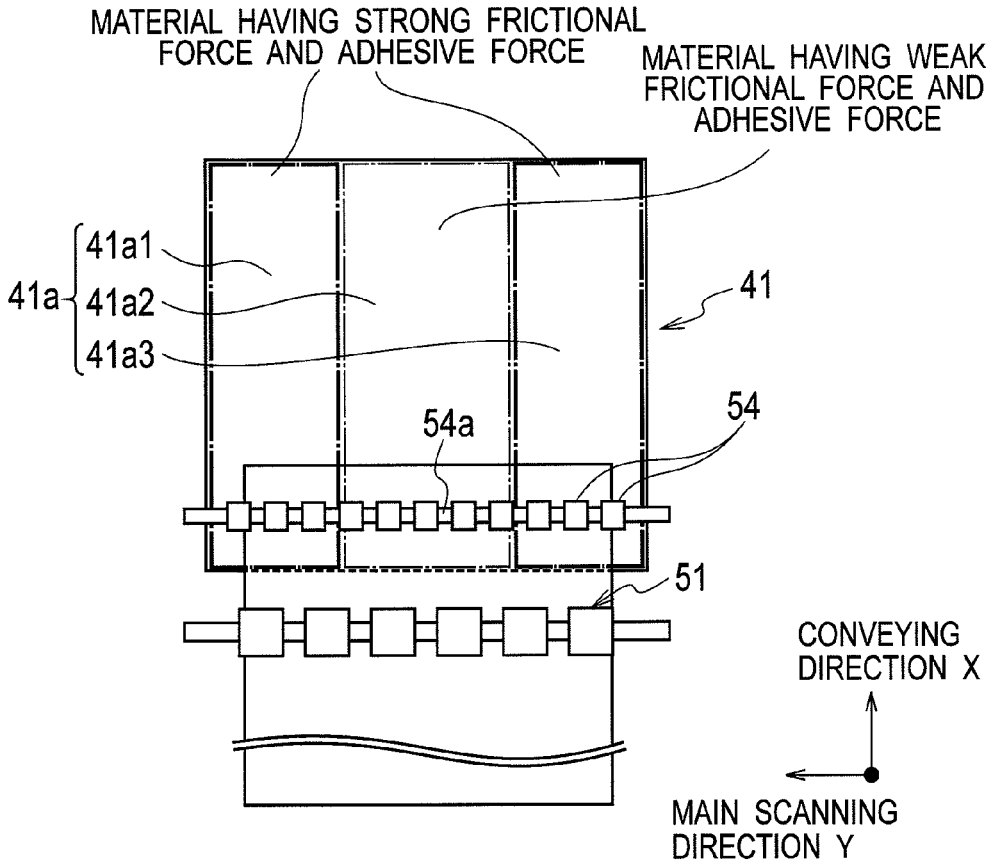
FIG. 11A is a plan view of a suction face of a belt platen of a multidrop-type inkjet printer according to another embodiment of the present invention.

For example, as shown in FIG. 11A, in the case where the suction face 41*a* of the belt platen 41 is made up of material having suction, the central portion and the right and left end portions of the belt platen 41 in the main scanning direction Y are made up of materials different in friction degree or degree of tackiness, or the suction face 41*a* of the central portion and the right and left end portions is subjected to surface treatment different in friction degree or degree of tackiness.

Figure 11B:
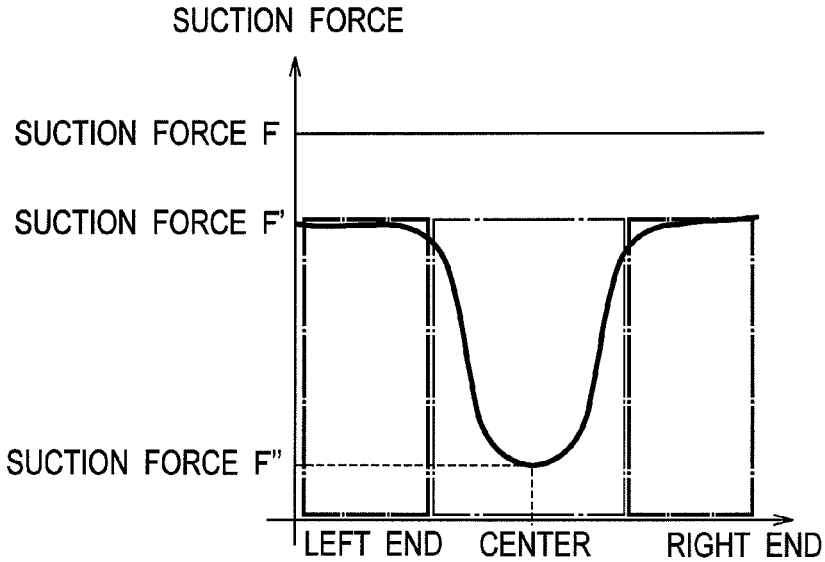
FIG. 11B is a graph that shows distribution of a suction force on a suction face of a belt platen in the multidrop-type inkjet printer according to another embodiment of the present invention.

Thereby, the suction force onto the recording sheet S, generated in the left and right regions a and c of the suction face 41*a*, can be made higher than that onto the recording sheet S, generate in the central region b. Even with such a configuration, as shown in FIG. 11B, in the suction face 41*a* of the belt platen 41, there can be realized a distribution in which the right and left end portions of the recording sheet S in the main scanning direction Y have a suction force relatively higher than the central portion, and there can be obtained the same effects as those in the above-mentioned embodiment.

In the present embodiment, there has been described, as an example, the line-type inkjet printer. However, the present invention can be applied to various image forming methods such as a so-called multipath-type inkjet printer and an electrophotographic method as long as it is an image forming apparatus for forming an image on the recording sheet conveyed in a state of being suctioned onto the conveyor belt (belt platen).

What is claimed is:

1. An image forming apparatus comprising:

a suction part;

a conveyor belt that conveys a recording sheet suctioned by the suction part, to an image forming part;

a plurality of sheet-pressing rollers that is arranged at intervals in a main scanning direction orthogonal to a conveying direction of the recording sheet by the conveyor belt, the sheet-pressing rollers pressing the recording sheet onto the conveyor belt before the recording sheet is conveyed to the image forming part; and a controller that controls suction strength of the suction part such that when a type of the recording sheet is a type meeting a predetermined condition, there is achieved a distribution in which a suction strength at both end portions of the suction part in the main scanning direction is higher than a suction strength at a central portion of the suction part in the main scanning direction, wherein the suction part is configured to float a portion of the recording sheet from the central portion of the suction part in the main scanning direction due to the lower suction strength at the central portion of the suction part in the main scanning direction, and wherein the plurality of sheet-pressing rollers are configured to distribute the floated portion of the recording sheet that passes between the sheet-pressing rollers to both end portions of the suction part in the main scanning direction.

2. The image forming apparatus according to claim 1, wherein the suction part has a plurality of negative-pressure generating parts that generates a negative pressure on a suction face of the conveyor belt, the negative-pressure generating parts are associated with respective divided regions on the suction face, the divided regions being set at least in the main scanning direction, and the controller controls the suction strength of the suction part by adjusting the strength of the negative pressure generated by each of the negative-pressure generating parts.

3. The image forming apparatus according to claim 1, further comprising a determining part that determines whether or not a type of the recording sheet designated in a printing job for forming an image on the recording sheet is a type meeting the predetermined condition, wherein when the determining part determines that the type of the recording sheet meets the predetermined condition, the controller controls the suction strength of the suction part so as to achieve the distribution, at execution of the printing job.

4. The image forming apparatus according to claim 2, the suction part comprises a plurality of suction fans.

5. An image forming apparatus comprising:

a suction part;

a conveyor belt that conveys a recording sheet suctioned by the suction part, to an image forming part; and a plurality of sheet-pressing rollers that is arranged at intervals in a main scanning direction orthogonal to a conveying direction of the recording sheet by the conveyor belt, the sheet-pressing rollers pressing the recording sheet onto the conveyor belt before the recording sheet is conveyed to the image forming part, wherein the suction part includes a plurality of members having different suction strengths in the suction part such that there is achieved a distribution that a suction strength at both end portions of the suction part in the main scanning direction is higher than a suction strength at a central portion of the suction part in the main scanning direction, wherein the suction part is configured to float a portion of the recording sheet from the central portion of the suction part in the main scanning direction due to the lower suction strength at the central portion of the suction part in the main scanning direction, and wherein the plurality of sheet-pressing rollers are configured to distribute the floated portion of the recording sheet that passes between the sheet-pressing rollers to both end portions of the suction part in the main scanning direction.

* * * * *